US005554005A

United States Patent [19]

Nguyen

[11] Patent Number: 5,554,005

[45] Date of Patent: Sep. 10, 1996

[54] BLADED ROTOR OF A TURBO-MACHINE

[75] Inventor: Uy-Liem Nguyen, Dättwil, Switzerland

[73] Assignee: ABB Management AG, Baden, Switzerland

[21] Appl. No.: 510,776

[22] Filed: Aug. 3, 1995

[30] Foreign Application Priority Data

Oct. 1, 1994 [DE] Germany ..... 44 35 268

[51] Int. Cl.[6] ..... F01D 5/30

[52] U.S. Cl. ..... 416/219 R; 416/248

[58] Field of Search ..... 416/219 R, 223 A, 416/248

[56] References Cited

U.S. PATENT DOCUMENTS

| | | | |
|---|---|---|---|
| 4,191,509 | 3/1980 | Leonardi | 416/219 R |
| 4,260,331 | 4/1981 | Goodwin | 416/219 R |
| 4,692,976 | 9/1987 | Andrews | 416/219 R |
| 4,824,328 | 4/1989 | Pisz et al. | 416/219 R |
| 5,110,262 | 5/1992 | Evans | 416/219 R |
| 5,147,180 | 9/1992 | Johnson | 416/219 R |
| 5,152,669 | 10/1992 | Heinig et al. | 416/219 R |
| 5,160,242 | 11/1992 | Brown | 416/219 R |

*Primary Examiner*—Edward K. Look
*Assistant Examiner*—Michael S. Lee
*Attorney, Agent, or Firm*—Burns, Doane, Swecker & Mathis

[57] ABSTRACT

In a bladed rotor (1) of a turbo-machine, the blade roots (3) and blade grooves are made pinetree-shaped with a plurality of indentations (10, 21) and teeth (11, 20). A plurality of supporting surfaces (F) extending obliquely are formed thereby. The indentations (10, 21), adjoining the supporting surfaces, in the blade root (3) and in the blade groove are described essentially by a first curve radius (R1) and a second curve radius (R2).

The first curve radius (R1) adjacent to the supporting surface (F) is smaller than the second curve radius (R2). The opening angle (W) between a tangent (T) to the circle arc (22), described by the first curve radius R1, at the end point (A, B) of the supporting surface and the supporting surface (F) amounts to at least forty degrees.

2 Claims, 2 Drawing Sheets

BLADED ROTOR OF A TURBO-MACHINE

BACKGROUND OF THE INVENTION

1. Field of the Invention

The invention relates to a bladed rotor of a turbo-machine, in which the blade roots and the blade grooves are made pinetree-shaped with a plurality of indentations and teeth, with the result that a plurality of supporting surfaces extending obliquely are formed, the indentations, adjoining the supporting surfaces, in the blade root and in the blade groove being described essentially by a first curve radius and a second curve radius.

2. Discussion of Background

Bladed rotors of this type are known from GB-A-2,011, 522. Each blade has, in its root region, indentations and teeth which hook into the correspondingly shaped teeth and indentations in the longitudinal grooves of the rotor. The indentations are described by two radii, a larger outer radius and a smaller inner radius. On the rotor, the larger radius is located further outwards radially relative to the rotor axis. On the blade, the larger radius is located further inwards radially relative to the rotor axis. When the rotor is in operation, centrifugal forces act on the blades and are compensated for by the rotor via the supporting surfaces formed by the indentations and teeth.

As a result of the above-described design of the teeth and indentations, a narrow gap between blade and rotor is formed adjacently to the supporting surfaces. This gap has the effect of a capillary, and, adjacently to the supporting surfaces, this can cause corrosion and pitting. This can lead to premature fatigue fractures in the blade root or in the groove of the rotor. Moreover, abrasion particles which have occurred during the operation of the rotor may penetrate into the gaps, remain there and possibly destroy protective layers applied to the surfaces.

SUMMARY OF THE INVENTION

Accordingly, one object of the invention is, in a bladed rotor of the type initially mentioned, to avoid premature fatigue fractures caused by corrosion in the pinetree-shaped fastener and to optimize the stress trends.

This is achieved, according to the invention, in that the first curve radius adjacent to the supporting surface is smaller than the second curve radius, and in that the opening angle between a tangent to the circle arc, described by the first curve radius, at the end point of the supporting surface, and the supporting surface amounts to at least forty degrees.

The advantages of the invention are to be seen inter alia in that the capillary effect in the vicinity of the supporting surface is eliminated. Abrasion particles are no longer retained and cannot cause damage to applied protective layers. Stresses adjacent to the supporting surface are reduced and therefore the lifetime of the components is increased.

It is particularly expedient, at the same time, if the opening angle is selected as large as possible, in order to reduce stresses adjacent to the supporting surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show an exemplary embodiment of the invention by reference to the drum rotor of a turbomachine and wherein.

Only the elements essential for understanding the invention are shown.

DESCRIPTION OF THE PREFERRED EMBODIMENTS

Figure 1:
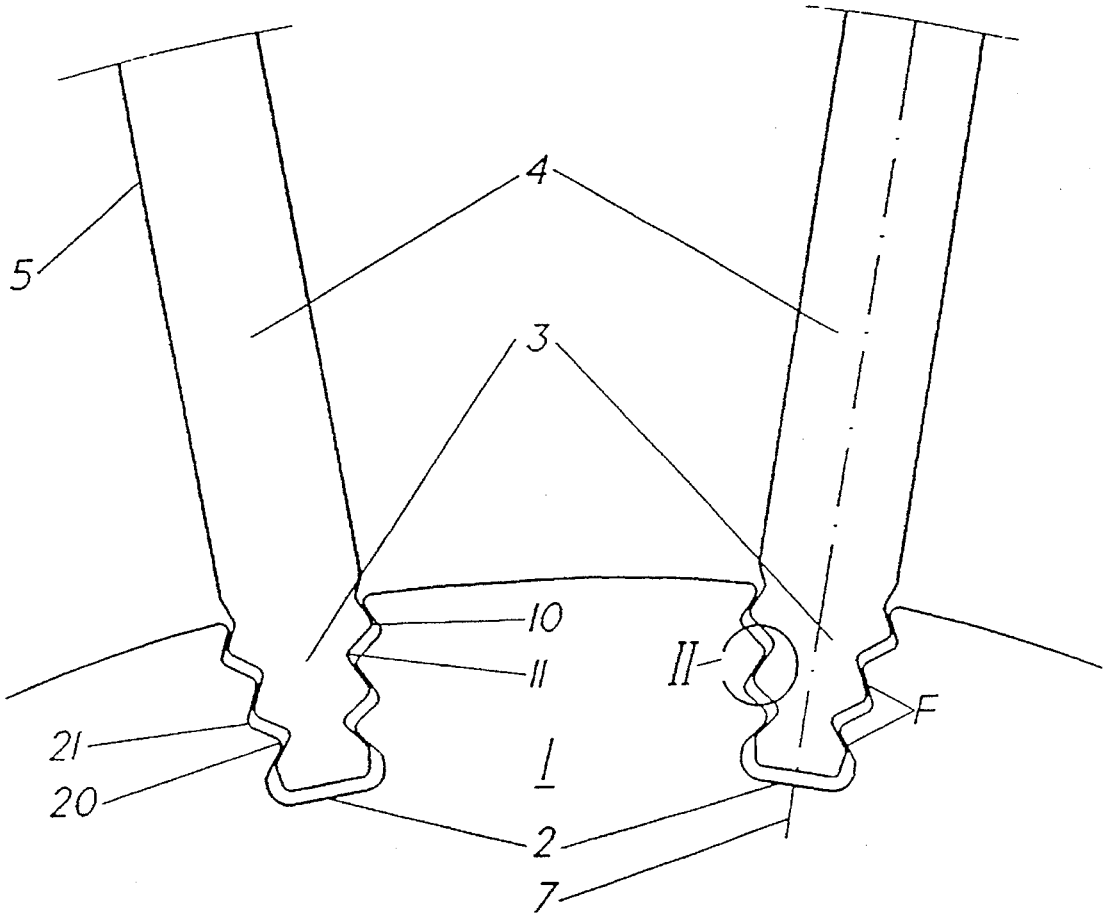
FIG. 1 is a part cross section through a bladed drum rotor.

Referring now to the drawings, wherein like reference numerals designate identical or corresponding parts throughout the several views, in FIG. 1 a drum rotor 1 is provided with moving blades 5. The moving blades 5 consist of a blade leaf 4 and a blade root 3. The moving blades are inserted with the blade roots 3 in axis-parallel blade grooves 2 of the drum rotor 1 which extend in the longitudinal direction. The blade root 3 is made pinetree-shaped with a plurality of indentations 10 and teeth 11. The blade grooves 2 in the drum rotor 1 are designed correspondingly with teeth 20 and indentations 21. When the rotor is rotated, the moving blades 5 are accelerated radially outwards, and they are retained by the drum rotor 1 by means of the pinetree-shaped fastening.

Figure 2:
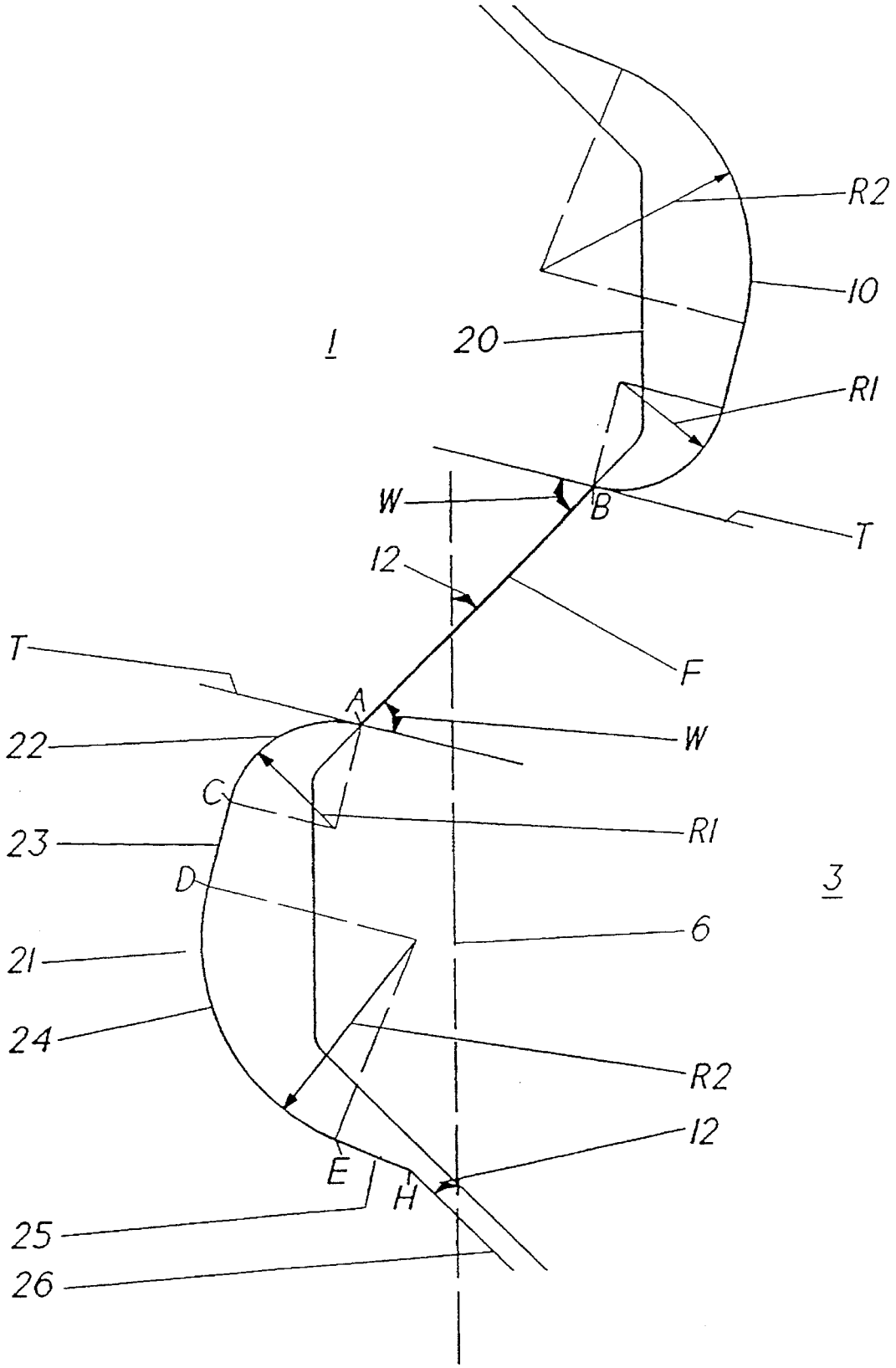
FIG. 2 is an enlarged cutout of detail II from FIG. 1.

According to FIG. 2, a supporting surface F, which has occurred during the rotation of the drum rotor 1 as result of the centrifugal acceleration of the moving blades 5, is arranged between an indentation 10 and an indentation 21. In order to simplify the further description, the extension of the moving blades and of the drum rotor perpendicular to the drawing plane is ignored below. Points therefore correspond in reality to straight lines and lines correspond to surfaces.

The supporting surface F is described by its end points A and B and by its angle of tilt 12 relative to a parallel 6 to the longitudinal axis 7 (FIG. 1) of the moving blade. The angle of tilt 12 usually amounts to forty to fifty degrees. The indentations 21 of the drum rotor 1 and the indentations 10 of the moving blades 5 are rotationally symmetrical. Only the indentations 21 are therefore described below. Points C, D, E and H are defined along the indentation 21 and serve for describing the geometry of the indentation.

A straight line is drawn through the end point A of the supporting surface F in such a way that it forms an opening angle W with the supporting surface. The angle W amounts, here, to sixty degrees for production-related reasons. The straight line T serves as a tangent for a circle arc A-C 22 having the radius R1 and the point A as an element of the circle arc A-C. The center of the circle which includes arc A-C 22 is thus located on a perpendicular to the tangent T through the point A. The end point of the circle arc A-C is located at C, where a straight line C-D 23 tangentially adjoins the circle arc A-C 22. The straight line C-D is at the same time tangential to a circle arc D-E 24 which is defined by the radius R2. The mid-point of the circle arc D-E is therefore located on a perpendicular to the straight line C-D 23 through the point D. The radius R2 is thus larger than the radius R1. At point E, a straight line E-H 25 tangentially adjoins the circle arc D-E. This straight line E-H merges at the point H into a straight line 26 of the tooth 20. The straight line 26 is tilted counter-clockwise at the angle of tilt 12 relative to the parallel 6 to the longitudinal axis 7 of the moving blade.

Of course, the invention is not restricted to the exemplary embodiment shown and described. The opening angle can advantageously also be selected even larger, if the production conditions allow. The shape of the indentation can also be designed without straight portions or with a combination of straight and curved portions, the decisive factor in this always being the optimization of the stress trend.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A bladed rotor of a turbo-machine, the rotor comprising pinetree-shaped blade roots and the pinetree-shaped blade grooves the blade roots and the blade grooves having a plurality of indentations and teeth defining a plurality of supporting surfaces extending obliquely, the indentations, adjoining the supporting surfaces, in the blade root and in the blade groove being described essentially by a first curve radius and a second curve radius, wherein the first curve radius adjacent to the supporting surface is smaller than the second curve radius, and wherein the opening angle between a tangent to the circle arc, described by the first curve radius, at the end point of the supporting surface, and the supporting surface amounts to at least forty degrees.

2. The bladed rotor as claimed in claim 1, wherein the indentations are formed by a combination of circle arcs and of straight lines tangentially adjoining the circle arcs.

* * * * *